US008971156B2

(12) United States Patent
El Kadiri

(10) Patent No.: US 8,971,156 B2
(45) Date of Patent: Mar. 3, 2015

(54) DEVICE FOR CONTROLLING A TIME FUNCTION OR NON-TIME-RELATED FUNCTION AND TIMEPIECE INCLUDING THE SAME

(75) Inventor: Hakim El Kadiri, Saint Blaise (CH)

(73) Assignee: Meco S.A., Grenchen (CH)

( * ) Notice: Subject to any disclaimer, the term of this patent is extended or adjusted under 35 U.S.C. 154(b) by 1873 days.

(21) Appl. No.: 12/294,657

(22) PCT Filed: Mar. 8, 2007

(86) PCT No.: PCT/CH2007/000123

§ 371 (c)(1),
(2), (4) Date: Dec. 13, 2010

(87) PCT Pub. No.: WO2007/109912

PCT Pub. Date: Oct. 4, 2007

(65) Prior Publication Data

US 2011/0085424 A1 Apr. 14, 2011

(30) Foreign Application Priority Data

Mar. 28, 2006 (EP) ..... 06006330

(51) Int. Cl.

| | |
|---|---|
| ***G04C 17/00*** | (2006.01) |
| ***G04B 37/00*** | (2006.01) |
| ***G04B 29/00*** | (2006.01) |
| ***H01H 9/26*** | (2006.01) |

(Continued)

(52) U.S. Cl.

CPC ..... *G04B 37/106* (2013.01); *G04B 3/043* (2013.01); *G04B 3/048* (2013.01)

USPC ..... 368/69; 368/290; 368/308; 368/319; 200/341; 200/520; 200/537

(58) Field of Classification Search

USPC ..... 368/69, 70, 224, 308, 319–321, 368/288–290; 200/5 A–5 E, 341, 520, 537

See application file for complete search history.

(56) References Cited

U.S. PATENT DOCUMENTS 3,303,295 A * 2/1967 Davis ..... 200/5 B
3,370,481 A * 2/1968 Mekelburg et al. ..... 74/503

(Continued)

FOREIGN PATENT DOCUMENTS

| | | |
|---|---|---|
| CH | 678138 A3 | 8/1991 |
| EP | 0 985 984 A1 | 3/2000 |
| EP | 1 553 468 A1 | 7/2005 |

OTHER PUBLICATIONS

International Search Report issued in corresponding application No. PCT/CH2007/000123, completed Aug. 27, 2007 and mailed Sep. 6, 2007.

(Continued)

*Primary Examiner* — Vit W Miska
(74) *Attorney, Agent, or Firm* — Griffin & Szipl, P.C.

(57) ABSTRACT

The invention concerns a device for controlling a time function or a non-time related function including at least two push-buttons (28A, 28B) each provided with a stem (30A, 30B) and a head (32A, 32B), said push-buttons (28A, 28B) being able to move axially between a first inactive rest position and a second position in which they control the function, characterized in that the stems (30A, 30B) of the two push-buttons (28A, 28*b*) extend side by side and parallel to each other. The invention also concerns a timepiece fitted with this control device.

15 Claims, 4 Drawing Sheets

(51) Int. Cl.

| | |
|---|---|
| ***G04B 37/10*** | (2006.01) |
| ***G04B 3/04*** | (2006.01) |

(56) References Cited

U.S. PATENT DOCUMENTS

| | | | | | |
|---|---|---|---|---|---|
| 3,402,620 | A | * | 9/1968 | Mukai et al. | 74/483 R |
| 4,035,627 | A | * | 7/1977 | Dickinson et al. | 708/130 |
| 4,072,004 | A | * | 2/1978 | Tanaka et al. | 368/69 |
| 4,083,027 | A | * | 4/1978 | Dobrosielski et al. | 337/66 |
| 4,093,992 | A | * | 6/1978 | Kawamura et al. | 708/111 |
| 4,143,252 | A | * | 3/1979 | Moore | 200/5 B |
| 4,188,136 | A | * | 2/1980 | Bedocs | 400/276 |
| RE31,634 | E | * | 7/1984 | Norby | 200/452 |
| 4,611,102 | A | * | 9/1986 | Ishida | 200/5 R |
| 4,760,221 | A | * | 7/1988 | Yoshida et al. | 200/408 |
| 4,831,218 | A | * | 5/1989 | Wright | 200/5 A |
| 4,831,219 | A | * | 5/1989 | Sugiura et al. | 200/5 A |
| 4,943,694 | A | * | 7/1990 | Kroth | 200/332.1 |
| 5,777,282 | A | * | 7/1998 | Ishiguro et al. | 200/5 E |
| 6,247,841 | B1 | | 6/2001 | Erard | |
| 6,705,783 | B1 | * | 3/2004 | Bowen | 400/472 |
| 6,835,902 | B2 | * | 12/2004 | Hiraoka | 200/5 A |
| 7,359,289 | B2 | | 4/2008 | Saunier | |
| 2004/0112721 | A1 | * | 6/2004 | Chao et al. | 200/5 A |

OTHER PUBLICATIONS

Random House Webster's College Dictionary 17 and 1088 (1991).

* cited by examiner

DEVICE FOR CONTROLLING A TIME FUNCTION OR NON-TIME-RELATED FUNCTION AND TIMEPIECE INCLUDING THE SAME

This is a National Phase Application in the United States of International Patent Application No. PCT/CH2007/000123 filed Mar. 8, 2007, which claims priority on European Patent Application No. 06006330.2, filed Mar. 28, 2006. The entire disclosures of the above patent applications are hereby incorporated by reference.

FIELD OF THE INVENTION

The present invention concerns a device for controlling a time function or non-time related function and a timepiece including the control device.

BACKGROUND OF THE INVENTION

The number of time functions with which a timepiece of the mechanical or electromechanical wristwatch type may be equipped is usually limited by the place available on the sides of the middle part of the watch for arranging the buttons used to control these functions. The problem is accentuated when the watch concerned is of small dimensions, such as a woman's model.

The problem linked to lack of space is particularly felt when one wishes to protect the control buttons by means of covers or caps which cover the buttons in a conventional manner. The external diameter of these covers is necessarily greater than that of the control buttons they cover and sufficient space must therefore be provided for the covers between two successive buttons.

Finally, although additional functions may be added to a watch, in order to save money, it is still sought to use a conventional timepiece movement. Measures must therefore be taken so that the control buttons for the additional functions can act on the timepiece movement in the desired manner.

FIG. 1 annexed to the present Patent Application is a top view of a mechanical watchcase including a chronograph mechanism. Designated as a whole by the general reference numeral 1, this watch case includes in a conventional manner a winding stem 2, arranged at three o'clock and a push-button 4 for starting the chronograph function and a push-button 6 for stopping and resetting to zero the same chronograph function. As can be seen upon examining the drawing, push-button 4 for starting the chronograph function is offset at an angle anti-clockwise relative to winding stem 2, arranged substantially at two o'clock, whereas push-button 6 for stopping and resetting the chronograph function to zero is offset at an angle clockwise relative to winding stem 2 and is arranged substantially at four o'clock. It is clear that with this arrangement of winding stem 2 and push-buttons 4 and 6, it is difficult to envisage adding an additional control member in the mid-day-six o'clock half of middle part 8 or protecting push-buttons 4, 6 by means of covers.

It is an object of the present invention to overcome the aforementioned drawbacks, in addition to others, by providing a device for controlling a time function or non-time-related function that allows substantial space saving to be achieved.

SUMMARY OF THE INVENTION

The present invention therefore concerns a device for controlling a time function or non-time-related function for a timepiece, wherein the control device includes at least two push-buttons, each provided with a stem and a head, characterized in that the stems of the two push-buttons extend side by side, parallel to each other.

Owing to these features, the present invention provides a control device including a double push-buttons assembly, whose two stems are arranged in parallel, side by side, such that the space requirement of this double push-button is reduced to a minimum. Place is therefore available for adding another control member or for installing this double push-button more easily in a watch of small dimensions.

According to a complementary feature of the present invention, the two pusher stems slide inside the same tube engaged in a through aperture made in the middle part of the watch.

The effect of this other feature is to limit both the number of machining operations to be carried out on the middle part and the number of parts employed for making the double push-button, which achieves substantial savings.

According to yet another feature of the invention, the heads of the two push-buttons have complementary shapes such that, when the two heads are in their non-pushed-in rest state, they form a circular external perimeter.

The present invention also concerns a timepiece fitted with a push-button of the type described above, characterized in that the double push-button is arranged in the three o'clock-six o'clock dial quarter of the watch.

According to another feature of the invention, the timepiece further includes an additional control member arranged in the twelve o'clock-six o'clock dial quarter of the watch.

In view of the above, and in accordance with a non-limiting illustrative embodiment of the present invention, a control device for controlling a time function or non-time related function for a portable object (10) is provided, wherein the portable object includes a lateral wall called the middle part (16), and the control device (26) includes at least two push-buttons (28A, 28B), wherein each push-button is provided with a stem (30A, 30B) and a head (32A, 32B), and the push-buttons (28A, 28B) are able to move axially between a first inactive rest position and a second position in which the push-buttons control the function, characterized in that the stems (30A, 30B) of the two push-buttons (28A, 28B) extend side by side, parallel to each other. In accordance with a second non-limiting illustrative embodiment of the present invention, the first non-limiting embodiment is modified so that the two pusher stems (30A, 30B) slide inside the same tube (38) engaged in a through hole (73) arranged in the middle part (16). In accordance with a third non-limiting, illustrative embodiment of the present invention, the second non-limiting embodiment is further modified so that the tube (38) is a staged tube including a first part (38A) whose inner diameter (D1) is greater than the inner diameter (D2) of a second part (38B) of the tube (38), wherein the heads (32A, 32B) of the pushers (28A, 28B) are able to slide inside the first part (38A) of the tube (38) while guided axially, whereas the stems (30A, 30B) slide while guided axially in the second part (38B) of the tube (38) that has a reduced diameter. In accordance with a fourth non-limiting, illustrative embodiment of the present invention, the third non-limiting embodiment is further modified so that the centre of the second part (38B) of the tube (38) has a separating wall (40), which delimits two cylindrical passages (42, 44) in which the stems (30A, 30B) of the push-buttons (28A, 28B) slide. In accordance with a fifth non-limiting, illustrative embodiment of the present invention, the fourth non-limiting embodiment is further modified so that a sealing gasket (46) is housed at the bottom of the second part (38B) of the tube (38) with a spring (48)

inserted between the gasket (46) and a bottom face (50A, 50B) of the pusher heads (32A, 32B). In accordance with a sixth non-limiting, illustrative embodiment of the present invention, the fifth non-limiting illustrative embodiment is further modified so that the pushers (28A, 28B) act on control members (56A, 56B) for a time function or non-time related function via at least one lever (58$A_1$, 58$A_2$; 58B).

In accordance with a seventh non-limiting illustrative embodiment of the present invention, the second, third, fourth, fifth and sixth non-limiting embodiments are further modified so that the external periphery of the tube (38) has a thread (64) for cooperating with an inner thread (66) provided in a cover (36) that covers the heads (32A, 32B) of the push-buttons (28A, 28*b*) in a removable manner. In accordance with an eighth non-limiting, illustrative embodiment of the present invention, the first, second, third, fourth, fifth, sixth and seventh non-limiting embodiments are further modified so that the heads (32A, 32B) of the pushers (28A, 28B) have complementary shapes such that, when the pushers (28A, 28B) are in an inactive position, the heads form a circular external periphery (D).

In accordance with a ninth non-limiting, illustrative embodiment of the present invention, a timepiece is provided that includes a control device (26) according to any of the first, second, third, fourth, fifth, sixth, seventh and eighth non-limiting embodiments described above. In accordance with a tenth non-limiting illustrative embodiment of the present invention, the ninth non-limiting embodiment is further modified so that it further includes an additional control member (20) arranged in the twelve o'clock-three o'clock dial quarter of the timepiece, whereas the control device (26) is arranged in the three o'clock-six o'clock dial quarter of the timepiece, characterized in that the control member (20) and the control device (26) are both covered in a removable manner by a cover (34, 36).

BRIEF DESCRIPTION OF THE DRAWINGS

Other features and advantages of the present invention will become clear from the following detailed description of an embodiment of the control device according to the invention, this example being given purely by way of non-limiting illustration with reference to the annexed drawing, in which.

DETAILED DESCRIPTION OF THE ILLUSTRATIVE EMBODIMENTS

The present invention proceeds from the general inventive idea that consists in providing a control device for time function or non-time-related functions, which is formed of two pusher stems arranged in parallel, side by side, so as to free space on the middle part of a watch for adding an additional control button or for installing this double push-button more easily in a watch of smaller dimensions, such as a woman's model.

Figure 1:
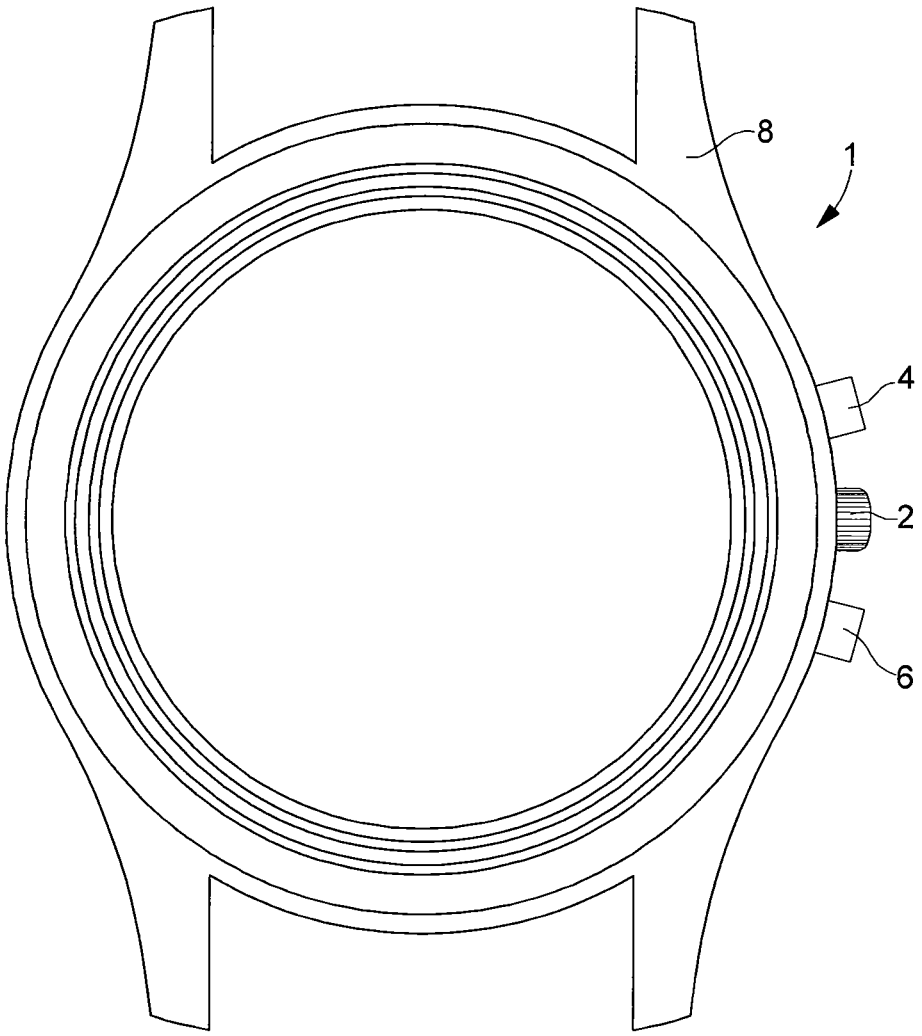
FIG. 1, already mentioned, is a top view of a mechanical watch case including a chronograph mechanism.
Figure 2:
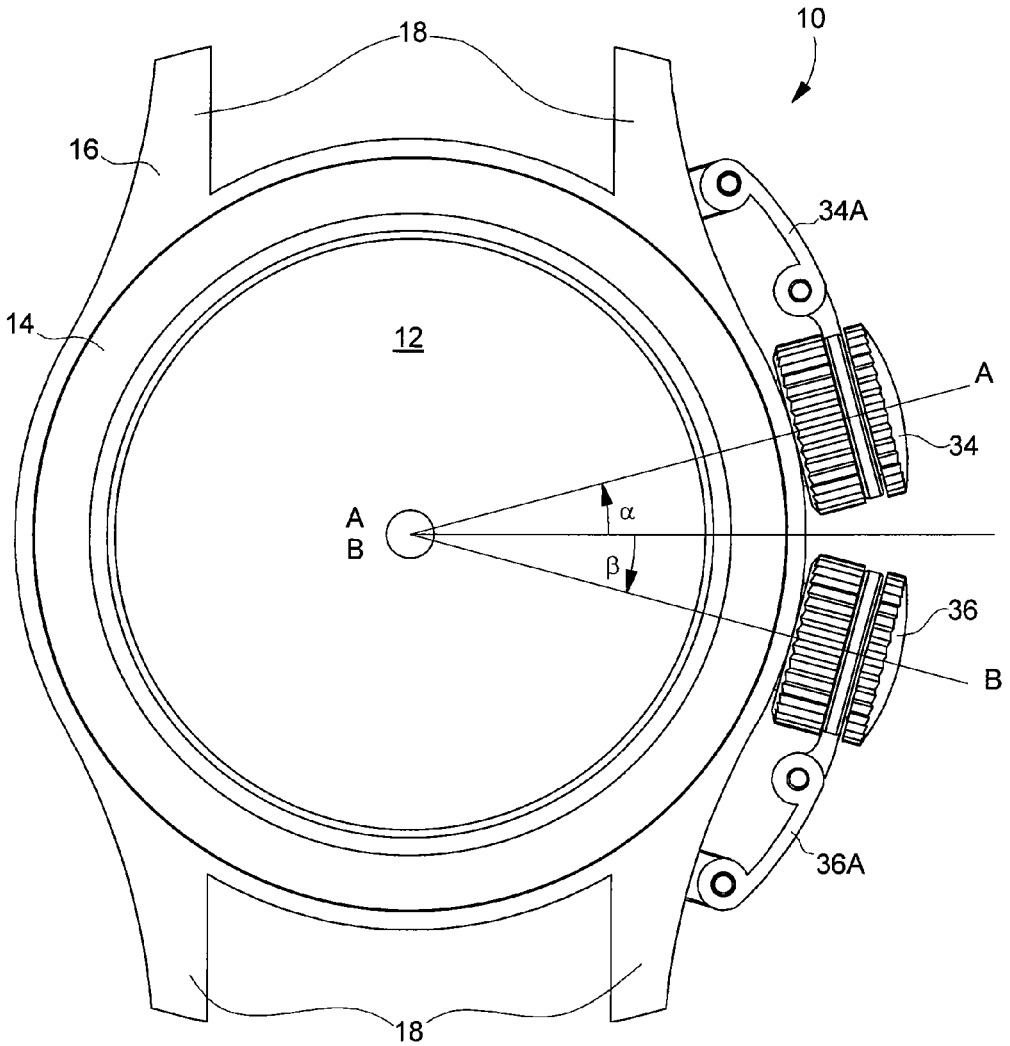
FIG. 2 is a top view of a watch case fitted with a control device according to the invention.

The watch according to the invention is shown schematically in a top view in FIG. 2. Designated as a whole by the general reference numeral 10, it includes, in a conventional and non-limiting manner, a crystal 12 held securely in position by a bezel 14, which is itself secured to a middle part 16. Middle part 16 is extended at midday and six o'clock by two pairs of horns 18 for securing the middle part to a wristband or bracelet that is not shown.

In the example shown, it is assumed that watch 10 is a mechanical watch including a winding stem 20 (see FIG. 3A) extended, at the end thereof located outside circular case 22 of watch 10, by a winding crown 24. This winding stem 20 is used in a conventional manner for winding the mainspring (not shown) of watch 10. As is visible in FIG. 2 and better still in FIG. 3A, winding stem 20 is arranged along a radius of circular case 22 of watch 10, in the twelve o'clock-three o'clock dial of the watch 10. More specifically, the axis of symmetry A-A of winding stem 20 forms an angle $\alpha$ of 15° with the three o'clock-nine o'clock axis of watch 10 in the anticlockwise direction. If one wishes to use a standard market movement M, this movement M must therefore be pivoted at the desired angle in case 22 of watch 10 such that the winding stem can drive the gear train, which kinematically connects the stem to the mainspring. Of course, the example of winding stem 20 has been given purely by way of illustration and one could envisage any other type of push-button type control device if watch 10 was, for example, of the electromechanical type, i.e. if the movement thereof was powered by a battery.

According to the invention, watch 10 is fitted with a second control device 26 formed (see FIG. 3) of two push-buttons 28*a* and 28B each including a pusher stem 30A and 30B extended at the free end thereof by a pusher head 32A and 32B respectively. As can be seen upon examining FIG. 2 and better still in FIG. 3, control device 26 is arranged along a radius of circular case 22 of watch 10, in the three o'clock-six o'clock dial quarter of the watch 10. More specifically, the axis of symmetry B-B of control device 26 according to the invention forms and angle $\beta$ of 15° with the three o'clock-nine o'clock axis of watch 10 in the clockwise direction.

As can be seen in FIG. 2, the winding crown 24 and control device 26 are each covered by a cover or cap 34 and 36 respectively, these covers 34 and 36 being connected to middle part 16 of watch 10 via two articulated hinges 34A and 36A respectively. As will be seen in more detail below, covers 34A and 36A are mounted to rotate freely at the free ends of hinges 34A and 36A so that they can be screwed in and unscrewed.

Figure 3A:
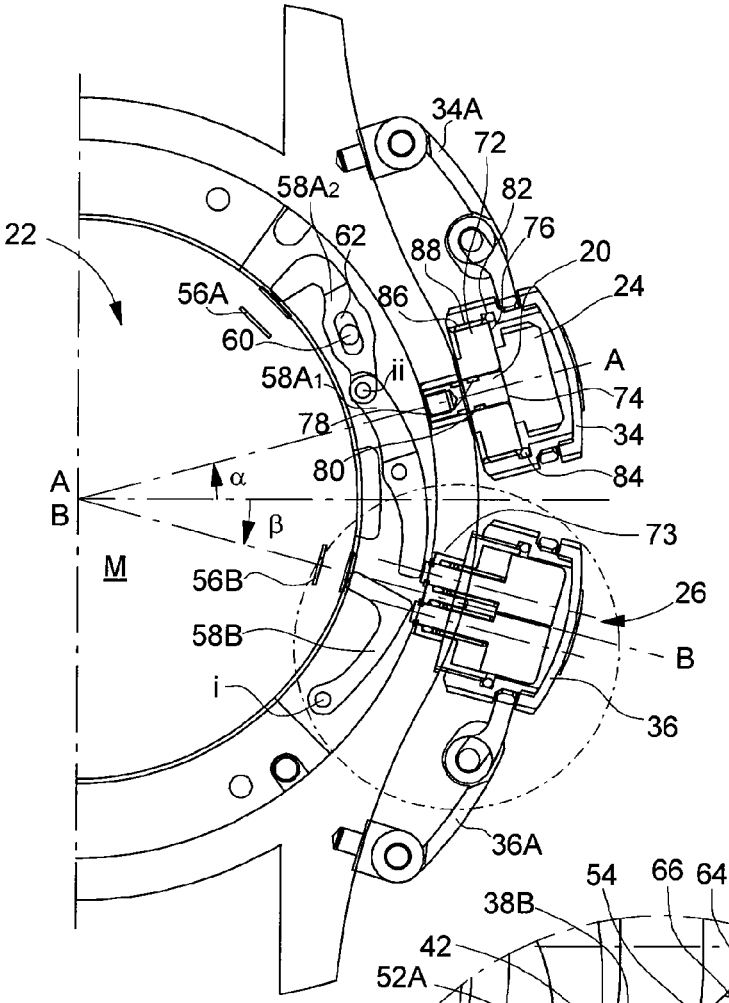
FIG. 3A is a horizontal top view of the watch case shown in FIG. 2, the cross-section passing through the control device according to the invention.
Figure 3B:
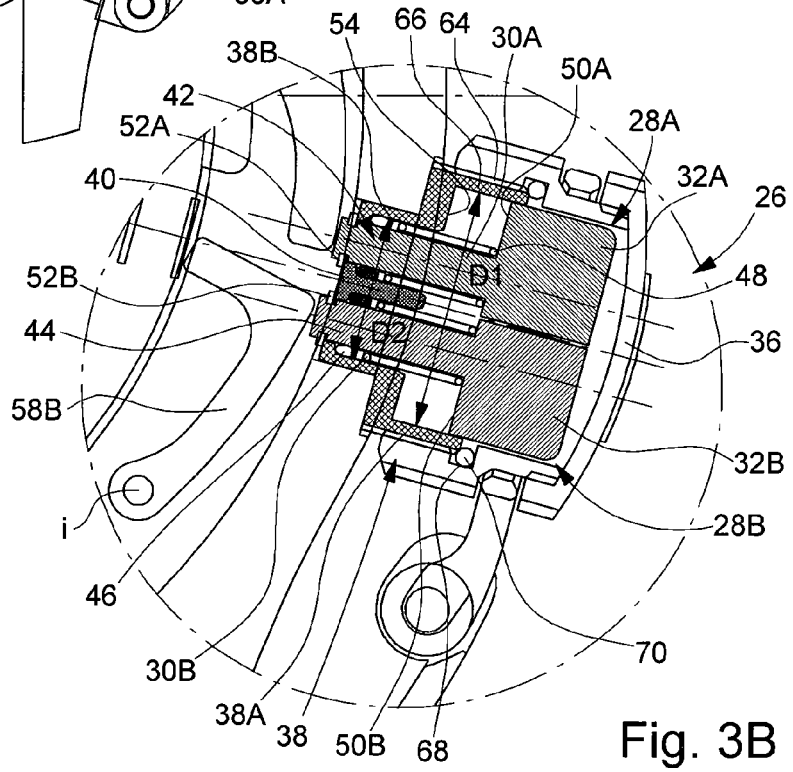
FIG. 3B is a larger scale detailed view of the region surrounded by a circle in FIG. 3A.
Figure 4:
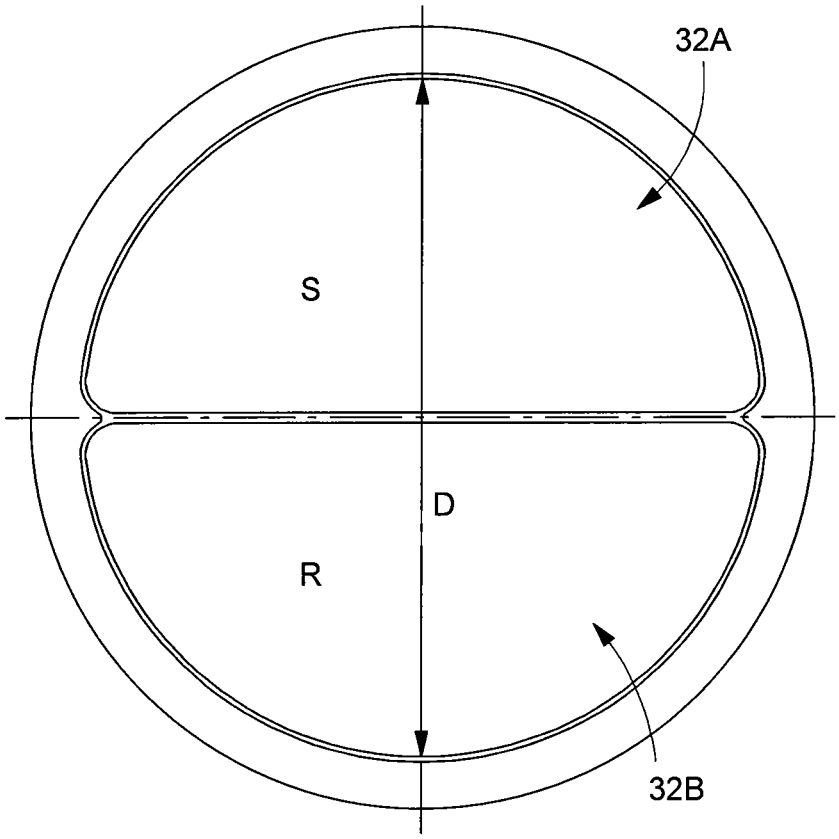
FIG. 4 is a front view of the control device according to the invention.

We will now examine in detail the structure of control device 26 according to the invention with reference to FIGS. 3A and 3B. This control device 26 essentially includes a tube 38 inside which pushers 28A and 28B are able to slide axially. This tube 38 is engaged in a through hole 73 made in middle part 16 of watch 10 and secured to the middle part 16 for example by being driven or screwed therein. More specifically, tube 38 is a staged tube including a first part 38A whose inner diameter D1 is greater than the inner diameter D2 of the second part 38B of tube 38. According to a feature of the invention, heads 32A and 32B of pushers 28A and 28B have complementary shapes such that, when the two heads are not pushed in, they form a circular external perimeter D (see FIG. 4). It will be clear that the inner diameter D1 of the first part 38A of tube 38 is equal to or slightly greater than the external perimeter D so as to allow heads 32*a* and 32B of pushers 28A and 28B to slide inside the first part 38A of tube 38 while being guided axially.

At the centre of the second part 38B of tube 38 there is a separating wall 40, which delimits two cylindrical passages 42 and 44 whose inner diameters are adapted to the diameters of stems 30A and 30B of pushers 28A and 28B. A sealing gasket 46 is housed at the bottom of the second part 38B of tube 38 with a spring 48 inserted between the gasket 46 and the lower face 50A, 50B of the pusher heads 32A, 32B. The two pushers 28A, 28B are retained axially by two key bolts 52A, 52B mounted at the end of pusher stems 30A, 30B outside tube 38. The two pushers 28A and 28*b* are thus free to move in translation between a first rest position in which they are held by key bolts 52A, 52B against the elastic return force of spring 48, and a second activated position in which they are pressed, via the bottom faces 50A, 50B thereof, against an inner shoulder 54 of tube 38.

Pusher 28B acts on a control member 56B for a time function or non-time related function via a lever 58B hinged to pivot at i.

Pusher 28A acts on a control member 56A of a time function or non-time-related function via a first lever 58$A_1$, hinged to pivot at ii and which is itself mounted to pivot on a second lever 58$A_2$ that can pivot and move in translation about a pivot 60 housed in an oblong hole 62 made in the second lever 58$A_2$.

The external periphery of first part 38A of tube 38 has a thread 64 for cooperating with an inner thread 66 provided in cover 36. Cover 36 also has a circular groove 68, which houses a sealing gasket 70.

Winding stem 20 is mounted to rotate freely in a tube 72 secured to middle part 16, for example by being driven or screwed therein. The bottom face 74 of the winding stem 24 of the stem abuts against a shoulder 76 of tube 72. Winding stem 20 has a circular groove 78 that houses a sealing gasket 80. Likewise, cover 34 has a circular inner groove 82 that houses a sealing gasket 84. Finally, the external periphery of tube 72 has a thread 86 for cooperating with a thread 88 provided on the inner periphery of cover 34.

Thus, owing to the present invention, by grouping two push-buttons at the same place, sufficient space is freed on the middle part of a watch to provide, for example, an additional push-button, or as described above, to provide covers to cover the control member according to the invention and, for example, a winding crown.

Broadly, however, the invention concerns a device for controlling a time function or a non-time related function including at least two push-buttons (28A, 28B), wherein each push-button is provided with a stem (30A, 30B) and a head (32A, 32B), wherein the push-buttons (28A, 28B) are able to move axially between a first inactive rest position and a second position in which they control the function, characterized in that the stems (30A, 30B) of the two push-buttons (28A, 28*b*) extend side by side and parallel to each other. The invention also concerns a timepiece fitted with this control device.

It goes without saying that the present invention is not limited to the embodiment that has just been described and that various simple modifications and variants could be envisaged by those skilled in the art without departing from the scope of the invention as defined by the annexed claims. In particular, the double push-button according to the invention could be used to control any type of time function or non-time-related function. By way of preferred but non-limiting example, the two push-buttons could be used to control a chronograph mechanism, one push-button being used to start the mechanism, while the other push-button is used to stop and reset the chronograph mechanism to zero. The present invention could apply to any type of portable object such as, in a non-limiting manner, a portable telephone, an electronic diary, a camera or apparatus. Preferably, the present invention will be applied to a wristwatch type timepiece which may be either purely mechanical, electromechanical or purely electronic.

The invention claimed is:

1. A control device for controlling a time function or non-time related function of a portable object that includes the control device and a lateral wall defining a middle part, wherein the control device includes:

(a) at least two push-buttons, wherein each push-button is provided with a stem and a head, wherein the at least two push-buttons are moveable axially between a first inactive rest position and a second position in which the at least two push-buttons control the time function or non-time related function of the portable object, wherein the stems of the at least two push-buttons extend side by side, parallel to each other, and wherein the at least two push-buttons are immediately adjacent to one another, wherein the two stems are pusher stems that slide inside a same tube engaged in a through hole arranged in the middle part of the portable object, and wherein the tube is a staged tube that includes a first part whose inner diameter is greater than an inner diameter of a second part of the tube, and the heads of the push-buttons are slideably disposed inside the first part of the tube while guided axially, whereas the stems of the push-buttons slide while guided axially in the second part of the tube that has a reduced diameter.

2. The control device according to claim 1, wherein the centre of the second part of the tube has a separating wall that delimits two cylindrical passages in which the stems of the push-buttons slide.

3. The control device according to claim 2, wherein a sealing gasket is housed at a bottom of the second part of the tube with a spring inserted between the sealing gasket and a bottom face of the heads of the at least two push-buttons.

4. The control device according to claim 3, wherein the at least two push-buttons act on control members for the time function or non-time related function via at least one lever.

5. The control device according to claim 1, wherein an external periphery of the tube has a thread for cooperating with an inner thread provided in a cover that covers the heads of the push-buttons in a removable manner.

6. The control device according to claim 1, wherein the heads of the at least two push-buttons have complementary shapes so that, when that at least two push-buttons are in the first inactive position, the heads of the at least two push-buttons form a circular external periphery.

7. A timepiece that is the portable object so the timepiece includes the control device according to claim 1.

8. The timepiece according to claim 7, further including an additional control member arranged in a twelve o'clock-three o'clock dial quarter of the timepiece, whereas the control device is arranged in a three o'clock-six o'clock dial quarter of the timepiece, and wherein the additional control member and the control device are both covered in a removable manner by a cover.

9. A timepiece that is a portable object having a time function or non-time related function, wherein the timepiece includes:

(a) a lateral wall defining a middle part;

(b) a control device that controls the time function or non-time related function of the timepiece, wherein the control device includes (i) at least two push-buttons, wherein each push-button is provided with a stem and a head, wherein the at least two push-buttons are moveable axially between a first inactive rest position and a second position in which the at least two push-buttons control the time function or non-time related function of the timepiece, wherein the stems of the at least two push-buttons extend side by side, parallel to each other; and (c) an additional control member arranged in a twelve o'clock-three o'clock dial quarter of the timepiece, whereas the control device is arranged in a three o'clock-six o'clock dial quarter of the timepiece, and wherein the additional control member and the control device are both covered in a removable manner by a cover.

10. A control device for controlling a time function or non-time related function of a portable object that includes the control device and a lateral wall defining a middle part, wherein the control device includes:

(a) at least two push-buttons, wherein each push-button is provided with a stem and a head, wherein the at least two push-buttons are moveable axially between a first inactive rest position and a second position in which the at least two push-buttons control the time function or non-time related function of the portable object, wherein the stems of the at least two push-buttons extend side by side, parallel to each other, and wherein the two stems are pusher stems that slide inside a same tube engaged in a through hole arranged in the middle part of the portable object, wherein the tube is a staged tube that includes a first part whose inner diameter is greater than an inner diameter of a second part of the tube, and the heads of the push-buttons are slideably disposed inside the first part of the tube while guided axially, whereas the stems of the push-buttons slide while guided axially in the second part of the tube that has a reduced diameter.

11. The control device according to claim 10, wherein the centre of the second part of the tube has a separating wall that delimits two cylindrical passages in which the stems of the push-buttons slide.

12. The control device according to claim 11, wherein a sealing gasket is housed at a bottom of the second part of the tube with a spring inserted between the sealing gasket and a bottom face of the heads of the at least two push-buttons.

13. The control device according to claim 12, wherein the at least two push-buttons act on control members for the time function or non-time related function via at least one lever.

14. The control device according to claim 10, wherein an external periphery of the tube has a thread for cooperating with an inner thread provided in a cover that covers the heads of the push-buttons in a removable manner.

15. A control device for controlling a time function or non-time related function of a portable object that includes the control device and a lateral wall defining a middle part, wherein the control device includes:

at least two push-buttons, wherein each push-button is provided with a stem and a head, wherein the at least two push-buttons are moveable axially between a first inactive rest position and a second position in which the at least two push-buttons control the time function or non-time related function of the portable object, wherein the stems of the at least two push-buttons extend side by side, parallel to each other, and wherein the at least two push-buttons are immediately adjacent to one another, wherein the two stems are pusher stems that slide inside a same tube engaged in a through hole arranged in the middle part of the portable object, and wherein a sealing gasket is housed at a bottom of the tube, wherein a spring is inserted between the sealing gasket housed at the bottom of the tube and a bottom face of the heads of the at least two push-buttons.

* * * * *